US010253618B2

(12) United States Patent
Safinya et al.

(10) Patent No.: US 10,253,618 B2
(45) Date of Patent: Apr. 9, 2019

(54) X-RAY BACKSCATTER IMAGING OF AN OBJECT EMBEDDED IN A HIGHLY SCATTERING MEDIUM

(71) Applicant: VISURAY INTECH LTD, Road Town, Tortola (VG)

(72) Inventors: Kambiz Safinya, Houston, TX (US); Adne Voll, Stavanger (NO); Andrii Sofiienko, Randaberg (NO); David Ponce, Randaberg (NO); Melissa Spannuth, Stavanger (NO); Henning Torsteinsen, Stavanger (NO)

(73) Assignee: VISURAY INTECH LTD, Road Town, Tortola (GB)

( * ) Notice: Subject to any disclaimer, the term of this patent is extended or adjusted under 35 U.S.C. 154(b) by 0 days.

(21) Appl. No.: 14/078,916

(22) Filed: Nov. 13, 2013

(65) Prior Publication Data

US 2014/0254764 A1 Sep. 11, 2014

Related U.S. Application Data

(60) Provisional application No. 61/773,524, filed on Mar. 6, 2013.

(51) Int. Cl.
*E21B 47/09* (2012.01)

(52) U.S. Cl.
CPC ..... *E21B 47/0905* (2013.01)

(58) Field of Classification Search
USPC ..... 378/87, 88; 702/6; 356/435, 301, 326, 356/436; 250/256, 269.1, 269.3, 253, 250/258.1
See application file for complete search history.

(56) References Cited

U.S. PATENT DOCUMENTS

| | | | | |
|---|---|---|---|---|
| 3,564,251 A | | 2/1971 | Youmans | |
| 3,976,879 A | | 8/1976 | Turcotte | |
| 4,847,814 A | | 7/1989 | Angehrn | |
| 4,883,956 A | | 11/1989 | Melcher et al. | |
| 5,946,220 A | * | 8/1999 | Lemelson | B01D 21/302 210/745 |
| 5,987,385 A | | 11/1999 | Varsamis et al. | |
| 6,078,867 A | | 6/2000 | Plumb et al. | |

(Continued)

FOREIGN PATENT DOCUMENTS

| | | |
|---|---|---|
| WO | 2010/138607 A1 | 12/2010 |
| WO | 2016/078727 A1 | 5/2016 |

*Primary Examiner* — David E Smith
*Assistant Examiner* — Hsien C Tsai
(74) *Attorney, Agent, or Firm* — Raymond R. Ferrera; Adams and Reese LLP

(57) ABSTRACT

An apparatus and associated method for obtaining a three-dimensional representation of a target object within a fluid-carrying conduit, such as a hydrocarbon exploration or production well, using high energy photons is provided. The representation is essentially a three-dimensional image that achieves visualization of the shape of the target object despite the intervening opaque fluids located between the imaging tool and the object. In one specific though non-limiting embodiment, a narrow, pencil-shaped beam of radiation is scanned in coordination with a similarly narrow detector field-of-view in order to sample the radiation-scattering properties of only a small volume of material at any given time. The result is a clearer visualization with a greater viewing depth.

17 Claims, 2 Drawing Sheets

(56) References Cited

U.S. PATENT DOCUMENTS

| | | | | |
|---|---|---|---|---|
| 6,678,050 | B2 | 1/2004 | Pope et al. | |
| 7,406,151 | B1 * | 7/2008 | Yun | G21K 7/00 378/43 |
| 7,675,029 | B2 | 3/2010 | Ramstad et al. | |
| 7,705,294 | B2 | 4/2010 | Ramstad et al. | |
| 7,924,978 | B2 * | 4/2011 | Harding | G01N 23/046 378/84 |
| 8,138,471 | B1 | 3/2012 | Shedlock et al. | |
| 2009/0175415 | A1 * | 7/2009 | Ramstad | E21B 47/0002 378/88 |
| 2009/0195647 | A1 | 8/2009 | Lynde | |
| 2010/0059219 | A1 | 3/2010 | Roberts et al. | |
| 2011/0122994 | A1 * | 5/2011 | Grubsky | G01T 1/20 378/62 |
| 2012/0057019 | A1 * | 3/2012 | Marchant | G01N 15/1459 348/135 |
| 2012/0127830 | A1 | 5/2012 | Desai | |
| 2012/0169841 | A1 | 7/2012 | Chemali et al. | |
| 2014/0241494 | A1 | 8/2014 | Spannuth et al. | |

* cited by examiner

X-RAY BACKSCATTER IMAGING OF AN OBJECT EMBEDDED IN A HIGHLY SCATTERING MEDIUM

FIELD OF THE INVENTION

The present invention relates generally to backscatter imaging techniques, and in a particular though non-limiting embodiment to an apparatus and method for obtaining a three-dimensional representation of a target object within a fluid-carrying conduit, such as a hydrocarbon exploration or production well, using high energy photons.

BACKGROUND OF THE INVENTION

Obtaining accurate data describing the shape and composition of objects located in a borehole has traditionally been a challenge, primarily due to the high temperatures and pressures within the borehole, the presence of associated opaque liquids, and significant space and maneuvering constraints. Furthermore, well operators need to obtain information as quickly as possible in order to minimize delays in operation, which can in some instances be extremely expensive. Known techniques for obtaining such images can be categorized in three basic classes: (1) those that use deformation of a mechanical probe; (2) those that use sound waves; and (3) those that use light.

In the first class, a mechanical probe or the like is deflected or deformed to create a representation of the borehole or a target object within the borehole. Typically, the probe is formed from a block of deformable material such as lead, which is lowered onto the target object and then retrieved. The resulting impression is interpreted to determine the shape of the object. However, since the impression must be brought to the surface for subsequent examination, this technique is time-consuming and does not easily admit to repeatable investigations.

For example, published U.S. Application No. 2009/0195647 A1 by Lynde discloses a technique in which a target object displaces a multitude of pins linked to sensors, and the measured displacements are then used to reconstruct the shape of a target object. This approach provides no information about the composition of the object, however.

Alternatively, U.S. Pat. No. 6,078,867 to Plumb et al. describes a system and associated method in which a multi-armed caliper scans a borehole, and the deflection of the arms is used to create a corresponding three-dimensional representation. Unfortunately, this method can only be used to look radially at the borehole walls or casing, and cannot be used to visualize objects disposed axially within the borehole.

In a second class, ultrasonic waves are emitted by a transducer, and the waves reflected from the object are recorded by receivers. For example, U.S. Pat. No. 4,847,814 to Anghern describes a system using multiple acoustic pulses to determine the distance to a borehole wall and thereby create a corresponding three-dimensional image. Similarly, U.S. Pat. No. 5,987,385 to Varsamis et al. discloses an acoustic logging tool that creates a circumferential image of a borehole during drilling. Published U.S. Application No. 2012/0127830 by Desai discloses a similar tool. While acoustic methods can provide quick feedback, they all have the drawbacks that any resulting data requires prior knowledge of the shape of the object; generally do not produce sufficiently clear images; and the results ultimately require expert interpretation.

In the third class, the target object is illuminated with electromagnetic radiation, typically visible light or x-rays, and radiation that is either reflected from or scattered by the object is used to create an image. For example, U.S. Pat. No. 6,678,050 to Pope et al. describes a technique for detecting and analyzing methane in coal bed methane formations using visible spectrum optical spectrometry, and published U.S. Application No. 2012/0169841 by Chemali et al. describes related optical tools and imaging methods. As a general matter, any technique using light at various optical wavelengths will suffer from distortion caused by the opacity of well fluids at those wavelengths. In order to obtain a clear image, the well fluids must therefore be replaced, which is a very costly and time-consuming operation.

Outside of the optical band, certain wavelengths of radiation can penetrate through the optically opaque fluids. For example, published U.S. Application No. 2010/0059219 by Roberts et al. describes a method that uses millimeter wavelength radiation to image target objects in a borehole. Unfortunately, millimeter wavelength imaging cannot provide information about the composition of the object.

Similarly, U.S. Pat. No. 3,564,251 to Youmans describes an apparatus in which x-rays scattered by the casing or the wall of an uncased borehole is recorded; U.S. Pat. No. 3,976,879 to Turcotte discloses a system that uses pulses of high energy photons to obtain information about the lithology of the earth formations surrounding a borehole; U.S. Pat. No. 8,138,471 to Shedlock et al. describes a device for inspecting wellbore casings and pipelines using a rotating pencil beam; and U.S. Pat. No. 4,883,956 to Melcher et al. discloses an apparatus and method for performing gamma-ray spectroscopy in a downhole environment. In all of these systems, however, the radiation is directed radially, and none are capable of visualizing an object located axially along the well.

In contrast, U.S. Pat. Nos. 7,675,029 and 7,705,294 to Ramstad et al. describe an apparatus and method for performing x-ray backscatter imaging in a fluid-carrying pipe. The x-ray imaging technique disclosed therein can produce images of objects located axially in the well, but affords very limited view depth and insufficient image clarity due to scattering by the well fluids.

While high energy radiation can penetrate through the optically opaque fluid to scatter from the target object, the radiation still scatters within the fluid and some of this scattering inevitably enters the detector. As the target object moves farther from the source and detector, an increasing amount of scattered radiation originating from the fluid enters the detector due to the increased volume of fluid both illuminated and viewed by the detector. Meanwhile, the amount of scattered radiation originating from the target object decreases due to the increased attenuation of the radiation incident upon the object. Consequently, objects become obscured as the distance between the x-ray source and object increases, thereby limiting the range of applicability of the methods.

There is, therefore, a longstanding but unmet need for an apparatus and method for obtaining a three-dimensional representation of a target object within a fluid-carrying conduit, such as a hydrocarbon exploration or production well, comprising means for overcoming the numerous technical deficiencies of the prior art.

SUMMARY OF THE INVENTION

A system for imaging an object disposed in a scattering medium using backscatter obtained from a source of electromagnetic radiation is provided, the system including at least: an electromagnetic radiation source of sufficiently high energy as to penetrate through a medium in which an object is disposed, the source emitting electromagnetic radiation of sufficient strength to form an image of the object; a means for restricting electromagnetic radiation emitted from the source; one or more detectors that detect energy emitted within a predetermined energy range and create electronic data associated therewith; and a software control system disposed in communication with a processor, wherein said software control system further comprises means for assembling and translating detected data into an electronic image representative of the shape of the object.

An associated method for imaging an object disposed in a scattering medium using backscatter from a source of electromagnetic radiation is also provided, the method including at least: emitting electromagnetic radiation from an electromagnetic radiation source, wherein the radiation is emitted at a sufficient strength as to penetrate through a medium in which an object is disposed and thereafter form an image of the object; restricting electromagnetic radiation emitted from the source; detecting energy emitted within a predetermined energy range; creating electronic data associated with said detected energy; disposing a software control system in communication with a processor, and using said software control system to assemble detected data into an electronic image representative of the shape of the object.

DETAILED DESCRIPTION OF SEVERAL EXAMPLE EMBODIMENTS

Figure 1:
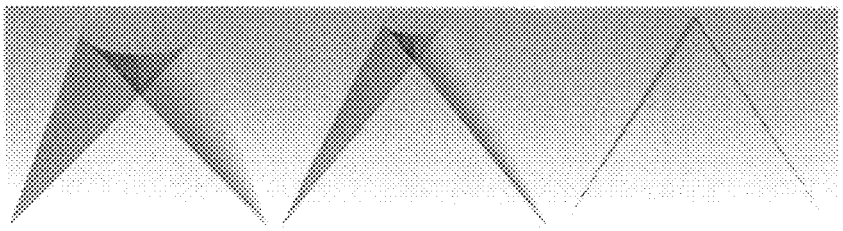
FIG. 1 illustrates a first aspect of the present invention.

The invention described here comprises an apparatus and method for obtaining a three-dimensional representation of a target object within a fluid-carrying conduit, such as a hydrocarbon exploration or production well, using high energy photons. The representation is essentially a three-dimensional image that achieves visualization of the shape of the target object despite the intervening opaque fluids located between the imaging tool and the object.

According to one example embodiment, a narrow, pencil-shaped beam of radiation is scanned in coordination with a similarly narrow detector field-of-view in order to sample the radiation scattering properties of only a small volume of material at any given time. The result is a clearer visualization with a greater viewing depth.

In order to create the clear visualization required, the scattering from the fluid that reaches the detectors must be minimized. This is achieved by forming the source radiation into a narrow beam, and then restricting the detector field-of-view to a similarly narrow beam. In this configuration, only the volume of material that lies within the intersection of the source beam and detector field-of-view will contribute to the signal registered by the detector. If the beam and field-of-view are sufficiently narrow, the overlap volume samples only a highly localized region of space. By scanning the source and detector in concert, the entire volume within a region of interest can be sampled, and a three-dimensional representation of the object constructed from the many small volume elements.

By minimizing the scattered radiation, originating from the fluid that enters the detector, the scanning beam method produces clearer visualizations and can investigate objects embedded deeper within the fluid than would otherwise be possible. Moreover, the technique also offers the benefit of three-dimensional information provided in a timely manner without the need for expert interpretation.

In order to obtain clear images of objects embedded deep within a highly scattering medium, the method minimizes detection of scattered photons originating from the medium. The principle of the method is to geometrically limit the volume of the medium that is simultaneously illuminated and viewed by the detector. This is accomplished using an associated apparatus that limits either (or both) the size of the incident beam of radiation or the field-of-view of the detector.

Minimum requirements for the system therefore include a collimated, moveable x-ray beam; a photon detecting device; a map of the beam position; measurements of the scattered intensity at many beam positions; and a display simultaneously showing all of the intensity measurements arranged in the appropriate relative positions.

The apparatus consists of the following main components: (1) a source of radiation in which the emitted radiation is of sufficiently high energy to penetrate through the medium to the object with sufficient strength to form an image; for most media x-rays or gamma rays will suffice; (2) a mechanism for restricting the radiation that exits the source and/or enters the detector, such as collimators or pinholes; the mechanism should be moveable so that the entire volume of interest can be sampled; (3) one or more photon detectors that can register photons in the appropriate energy range; (4) an algorithm for assembling the acquired data into an image or other representation of the shape of the object; and (5) a software control system that sets and monitors the collimator positions, controls detector exposure and readout, and stores the table of beam sizes and positions versus collimator orientation.

The physical principle underlying this method relies upon the geometrical relationship between the volume of medium and the volume of an object that lies within the region of space that is both illuminated by the source and from which scattered radiation can reach the detector.

As depicted in FIG. 1, when the radius of an incident beam decreases, the volume of fluid material within the intersection of the illumination and detection regions decreases more quickly than the illumination volume alone because the intersection point of the two regions changes accordingly. Meanwhile, the volume of the object material within the intersection decreases only according to the cross-sectional area of the illumination beam because the depth into the object being illuminated is primarily determined by the attenuation characteristics of the subject material. Thus, as the illumination beam radius is decreased, the ratio of scattering from the object to scattering from the medium increases and image quality improves.

Decreasing the field-of-view of the detector has an analogous effect. In the extreme limits of an infinitely thin illumination beam and perfectly collimated detector, scattering from only a single point in space is registered by the detector, and scattering from the medium is nearly eliminated when the point lies within the object volume. Some photons that have been multiply scattered in the medium will still enter the detector.

Figure 2:
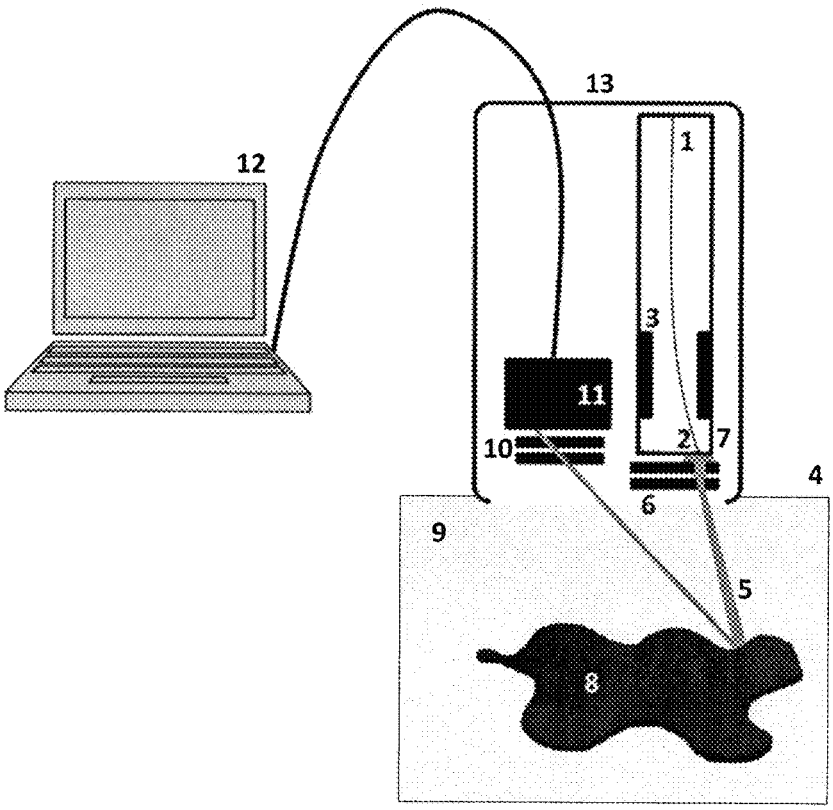
FIG. 2 illustrates a second aspect of the present invention.

In the example embodiment depicted in FIG. 2, restriction of the illumination region and the detector field-of-view is achieved by a system of rotating collimators [6] that shape the outgoing radiation [5], and similar collimators [10] that limit the scattered radiation incident upon the detector [11].

A representation of the object is then created by scanning the radiation beam and the detector field-of-view in discrete steps, so that their intersection volume covers the entire volume in the region of interest [4]. The magnitude of the scattering and the positions of the collimators are both recorded for each discrete step and later reconstructed for display.

Ideally, radiation is produced by Bremsstrahlung (electromagnetic radiation produced by the deceleration of a charged particle when deflected by another charged particle) obtained from a beam of high energy electrons [1] impinging upon a target made of tungsten or another suitable material with a high atomic number [2].

The electrons are accelerated through a potential difference of between around 180 kV and around 240 kV or more in order to increase the number of high energy photons produced, and the electron beam current should between around 1 mA and around 2 mA or more in order to provide sufficient photon flux. In one example embodiment, the electron beam forms a small spot on the anode target, and its position on the target is adjustable via electromagnetic control [3] or other appropriate techniques. The emitted radiation will contain photons with a spectrum of energies up to a maximum determined by the electron accelerating potential.

Photons with energies between 180 and 240 keV work especially well because they interact less strongly with the medium than lower energy photons, yet the scattered photons are still of sufficiently low energy as to be registered with high efficiency by the detector. Such an arrangement for the source maximizes the flux of photons with the appropriate energy in the desired beam direction. However, other source types or arrangements will be evident to those of skill in the pertinent arts.

In another example embodiment, the electron beam is defocused in order to create a broad spot on the anode target. The electron beam spot may be immobile, different accelerating potentials may be used, and/or filters may be installed outside the target in order to decrease the amount of low energy photons incident upon the region of interest.

With reference again to the example embodiment of FIG. 2, between the radiation source and the region of interest [4], the radiation is preferably shaped into a narrow beam [5] that can be directed towards different locations within the region of interest. In one specific example embodiment, this is achieved using a pair of rotating collimators [6] placed immediately downstream of the source housing [7]. In one embodiment the collimators are pieces of tungsten around 10 mm thick or more; other materials with large densities, such as lead or a heavy metal alloy can also be used.

In a further embodiment, one collimator has a radial slot cut into it and the other has a spiral-shaped slot. When the two collimators are placed adjacent to each other, the radiation is restricted to a narrow beam defined by the path through the two collimators. For slots with widths of approximately 0.3 mm each, these collimators will produce a beam width of approximately 6 mm at 100 mm distance from the collimators.

Rotating the collimators independently allows the beam to be directed at specific points within a region of interest. For example, if the collimators are placed very close to the source target at a maximum slot radius of 20 mm, the field-of-view in the radial direction extends approximately 120 mm from the source axis at 100 mm distance from the collimators. This configuration will provide coverage of substantially the entire well diameter in most cases. Ordinarily skilled artisans will readily recognize that other collimator types or arrangements can also be employed.

After interacting with the material in the region of interest, either the target object [8] or the fluid [9], the scattered radiation passes through a radiation-limiting aperture [10] and is registered by one or more detecting devices [11]. In one embodiment, the apertures are rotatable collimators similar in design to those on the source, and one set is placed in front of each detector.

In this particular configuration, both the incident radiation and the field-of-view of each detector have a narrow cross-section. When these radiation and detection 'beams' intersect in the region of interest, the scattering from only the small intersection volume will be registered. In one specific though non-limiting embodiment, each detector is a single-crystal sodium iodide scintillator and photomultiplier tube combination capable of recording spectral information of the registered photons.

In yet another non-limiting embodiment, cesium iodide in either crystalline or polycrystalline form may be used as a scintillator together with a photomultiplier tube. Other types of scintillators such as lanthanum bromide coupled with the appropriate photomultiplier may also be used. Those skilled in the relevant arts will appreciate that a scintillator comprising either a single crystal or a polycrystalline material coupled to a photomultiplier without limitation to the exact scintillator material or photomultiplier may be used as a suitable detector.

Such detectors are well-suited to oil-field applications, as they can better withstand the high temperatures typically present in deep boreholes. Other detector types and arrangements will be evident to those skilled in the art and will be appropriate in some circumstances. In the depicted embodiment the detector data are then sent to a surface processing station [12] in order to create the representation.

While the depicted embodiment provides one possible configuration of source and detector collimation that will isolate the scattering from a localized volume within the region of interest, many other variations are possible that do not substantially depart from the scope of the instant disclosure.

Other example embodiments include different collimator shapes that provide a moveable beam of radiation and/or a moveable detector field-of-view; a segmented detector in which the values from each pixel are summed; changes to the size of the radiation beam or detector field-of-view; multiple sets of interchangeable collimators tailored for different situations; collimators with continuously adjustable aperture size; and/or not collecting spectral data about the registered photons.

Still other representative changes to the apparatus will capture the essence of the disclosed method. For example, the detector aperture may be stationary, such as a pinhole, so that the detector accepts radiation from the entire region of interest illuminated by the narrow beam of radiation. In this embodiment, a pixelated detector can be used (e.g., a solid-state device of cadmium telluride or cadmium zinc telluride); in this case each pixel functions as an independent detector with its own field-of-view determined by the pinhole. Thus, the illuminated region is subdivided into sectors by the pixels on the detector, and small volumes are sampled.

In this particular configuration, neighboring pixels necessarily sample overlapping volumes; in contrast, when both the radiation beam and detector field-of-view are moveable, independent volumes can also be sampled if desired.

Other efficiencies can be achieved in configurations where only one of either the radiation source or the detector is collimated. For example, in some embodiments, the source may be shaped into a narrow, moveable beam, but the detector (which is preferably not segmented) can register radiation originating from any point within the region of interest.

In this case, radiation scattered by the medium in front of the object will be registered by the detector. However, the ratio of radiation originating from the object to that originating from the medium will increase as the size of the beam decreases; the ratio is therefore maximized for an infinitesimally narrow beam.

Figure 3:
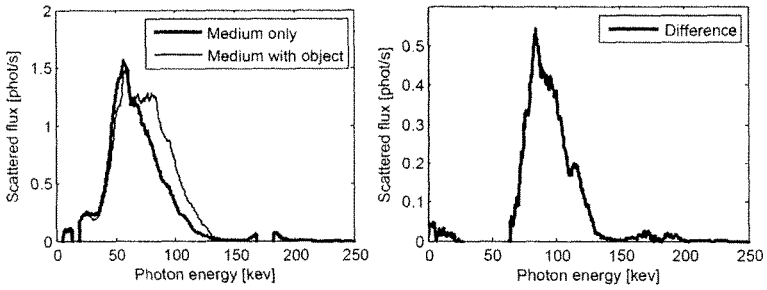
FIG. 3 illustrates a third aspect of the present invention.

Another advantage achieved in this particular embodiment is depicted in FIG. 3, found in which the left-hand panel shows the flux of scattered radiation as a function of energy for an object embedded within a medium and for the medium alone; the right-hand panel then shows the difference between the two signals.

The data presented in FIG. 3 were obtained using a beam diameter of approximately 0.6 mm at the source collimator. With source collimation, the signal from the object embedded within the medium is distinguishable from the signal obtained from the medium alone, whereas without collimation this distinction is not generally possible.

A housing [13] is also provided in order to protect the components from damage by the well fluids. In one example embodiment, the housing is less than around 3⅝ inches in diameter in order to fit within a reasonable number of cased wells. The end of the housing through which the radiation passes optimally comprises a material that is transparent to radiation in the primary energy range used; in many instances beryllium offers adequate functionality, though many other materials can also be used to satisfactory effect.

It is generally desirable that the remainder of the housing body is capable of withstanding pressures up to 20 kpsi. In addition, components should be capable of withstanding operational temperatures of around 150° C. or more. A cooling system may be necessary to dissipate the heat from the radiation source and/or to maintain the detectors within the acceptable temperature range.

Figure 4:
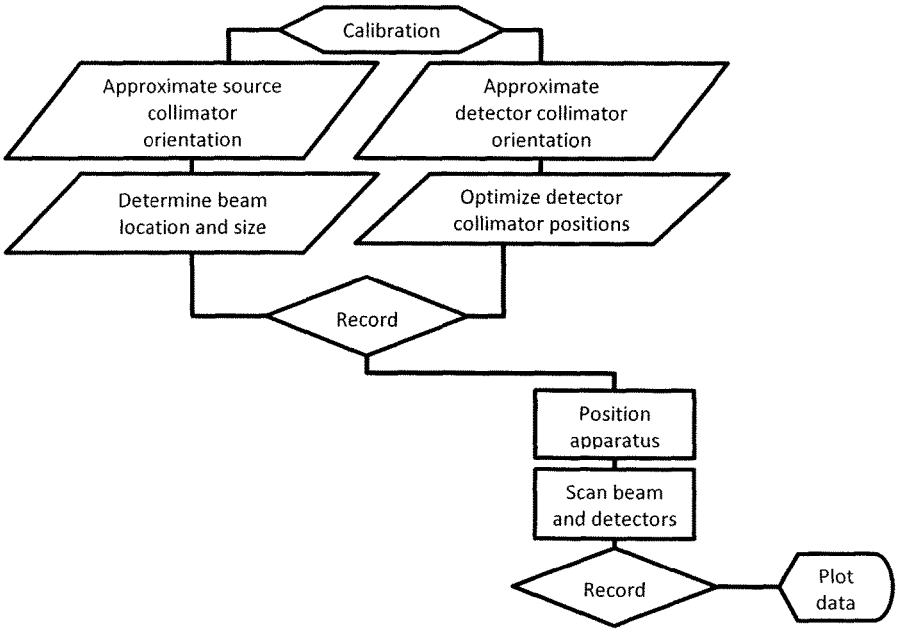
FIG. 4 illustrates a fourth aspect of the present invention.

Ultimately, scattered radiation from the entire region of interest is registered by the detectors, and analyzed in order to construct a representation of the object. A representative example of this procedure is depicted in the diagram presented in FIG. 4. In one embodiment, data collection and reconstruction comprises first calibrating the source beam and detector field-of-view locations in relation to the expected positions based upon known collimator positions and geometries.

Such calibration allows the rotational positions of all collimators to be correlated with the position in space of the volume sampled when the collimators are in the given position. Once the calibration is complete, a recorded signal of the scattered radiation is mapped against a particular volume within the region of interest based upon the position of the collimators at the time the signal was recorded.

In a typical data collection routine, the instrument is moved into a location as near the target object as reasonably achievable. The source and detector collimators are then scanned step-wise in a predetermined pattern so that the entire volume of the region of interest is systematically sampled. In one embodiment, the electron beam in the source simultaneously scans with the collimators in a manner that maximizes photon flux through the source collimators.

In one specific embodiment, all of the collimators are held in a given position for a sufficient amount of time as to ensure a good signal-to-noise ratio for the detected signal, and then moved to the next position. The scattering signal is then recorded along with the position of the collimators and either processed for image reconstruction in a downhole processor in the tool or immediately transmitted to the surface for reconstruction.

Reconstruction involves using the calibration table to create a visual representation of the scattering signal. The table correlates the recorded positions of the collimators with the position of the volume element sampled by each recorded radiation signal. Once the signal is correlated with its position, the data can be plotted in two or three dimensions using any satisfactory technique therefor, and the resulting representation is interpreted to obtain information regarding the geometry of the target object.

Within the context of this application, terms such as "appropriately programmed software", "software package" and "means for [some particular software-related functionality stated herein and its equivalents]" mean a software program or a software package with appropriate hardware/software/firmware interface means as to enable the various software-related functionality described and inherently inferred herein, such as machine code, source code, object code, algorithms, code operators and indicators and the like that act directly or indirectly, with or without the temporal assistance of related hardware or firmware, in order to carry out at least the functionality specified herein, regardless of whether such functionality or means therefor are presently known or future devised, so long as said functionality and means therefor reside within the present understanding of one of ordinary skill in the art.

In one particular though non-limiting representative operational mode, three-dimensional information relating to the target object is available and displayed in near real-time. Other operating modes are also possible, without deviation from the scope of the instant disclosure. For example, in other embodiments data is transmitted to the surface after some time delay; stored in the tool and brought to the surface when the tool is recovered; and/or processed in whole or in part on-board the tool.

The foregoing specification is provided for illustrative purposes only, and is not intended to describe all possible aspects of the present invention. Moreover, while the invention has been shown and described in detail with respect to several exemplary embodiments, those of skill in the pertinent arts will appreciate that minor changes to the description and various other modifications, omissions and additions may be made without departing from the scope thereof.

The invention claimed is:

1. A system for creating a three-dimensional representations of an object disposed in a scattering medium using backscatter obtained from an x-ray radiation source of sufficiently high energy as to penetrate through the medium in which the object is disposed, the system comprising:

an x-ray radiation source of sufficiently high energy as to penetrate through the medium in which the object is disposed, said source emitting x-ray radiation of sufficient strength to create a three-dimensional representation of the object;

a restrictor for restricting x-ray radiation from said source to provide a pencil-shaped beam of radiation that is scanned in coordination with a similarly narrow detector field-of-view through coordinated movable collimators;

one or more detectors that detects energy emitted within a predetermined energy range and creates electronic data associated therewith; and a software control system disposed in communication with a processor, wherein said software control system further comprises means for assembling and translating detected data into an electronic representation of the three-dimensional form of the object.

2. The system of claim 1, wherein said means for restricting electromagnetic radiation further comprises one or more pinhole type apertures beyond and through which said radiation is emitted.

3. The system of claim 1, further comprising means for electromagnetically deflecting an electron beam.

4. The system of claim 1, wherein said one or more detectors detect the presence of one or more of photons, x-rays and gamma rays.

5. The system of claim 1, wherein said one or more detectors detect photons with energy within a predetermined energy range.

6. The system of claim 1, wherein said software control system further comprises means for setting and monitoring the position of an associated collimator.

7. The system of claim 1, wherein said software control system further comprises means for detecting and controlling detector exposure to radiation, and for initiating an electronic data signal that can be translated into a three-dimensional representation of the object.

8. The system of claim 1, wherein said software control system further comprises means for organizing acquired image data into look up tables relating to the sizes and positions of collimated objects.

9. A method for creating a three-dimensional representation of an object disposed in a scattering medium using backscatter from a source of x-ray radiation, the method comprising:

emitting x-ray radiation from an x-ray radiation source, wherein said radiation is emitted at a sufficient strength as to penetrate through the medium in which the object is disposed and thereafter create a three-dimensional representation of said object;

restricting x-ray radiation emitted from said source to provide a pencil-shaped beam of radiation that is scanned in coordination with a similarly narrow detector field-of-view through coordinated movable collimators;

detecting photons with energy emitted within a predetermined energy range;

creating electronic data associated with said detected energy; and disposing a software control system in communication with a processor, and using said software control system to assemble detected data into an electronic image representative of the three-dimensional form of the object.

10. The method of claim 9, further comprising restricting x-ray radiation using one or more pinhole type apertures beyond and through which said radiation is emitted.

11. The method of claim 9, further comprising detecting the presence of one or more of photons, x-rays and gamma rays.

12. The method of claim 9, further comprising detecting photons with energy within a predetermined energy range.

13. The method of claim 9, further comprising using said software control system to set and monitor the position of an associated collimator.

14. The method of claim 9, further comprising using said software control system to detect and control detector exposure to radiation, and to initiate an electronic data signal that can be translated into a three-dimensional representation of the object.

15. The method of claim 9, further comprising using said software control system to organize acquired image data into look up tables relating to the sizes and positions of collimated objects.

16. The system of claim 1, wherein said means for restricting radiation emitted from said source further comprises one or more spiral collimators.

17. The method of claim 9, further comprising restricting electromagnetic radiation emitted from said source using one or more spiral collimators.

* * * * *